US007438397B2

(12) United States Patent
Anderson, Jr. et al.

(10) Patent No.: US 7,438,397 B2
(45) Date of Patent: Oct. 21, 2008

(54) METHODS AND DEVICES FOR PURGING GASES FROM AN INK RESERVOIR

(75) Inventors: James Daniel Anderson, Jr., Harrodsburg, KY (US); David Emerson Greer, Lexington, KY (US); Matthew Joe Russell, Stamping Ground, KY (US)

(73) Assignee: Lexmark International, Inc., Lexington, KY (US)

( * ) Notice: Subject to any disclaimer, the term of this patent is extended or adjusted under 35 U.S.C. 154(b) by 326 days.

(21) Appl. No.: 11/001,433

(22) Filed: Dec. 1, 2004

(65) Prior Publication Data

US 2006/0114298 A1 Jun. 1, 2006

(51) Int. Cl.
*B41J 2/17* (2006.01)
*B41J 2/175* (2006.01)

(52) U.S. Cl. ..... 347/84; 347/85

(58) Field of Classification Search ..... 347/84, 347/85

See application file for complete search history.

(56) References Cited

U.S. PATENT DOCUMENTS 4,149,172 A * 4/1979 Heinzl et al. ..... 347/92
5,126,767 A * 6/1992 Asai ..... 347/86
5,426,459 A 6/1995 Kaplinsky
5,500,664 A 3/1996 Suzuki et al.
5,621,445 A * 4/1997 Fong et al. ..... 347/87
5,677,718 A * 10/1997 Crawford et al. ..... 347/92
5,812,168 A 9/1998 Pawlowski, Jr. et al.
5,844,577 A * 12/1998 Pawlowski, Jr. ..... 347/6
5,847,734 A 12/1998 Pawlowski, Jr.
5,870,126 A 2/1999 Kondo et al.
5,936,650 A * 8/1999 Ouchida et al. ..... 347/89
5,949,459 A 9/1999 Gasvoda et al.
6,079,808 A * 6/2000 Yamaguchi ..... 347/30
6,209,997 B1 4/2001 Duong et al.
6,257,714 B1 7/2001 Seccombe
6,257,715 B1 7/2001 Thielman et al.
6,270,211 B1 8/2001 Long et al.
6,296,345 B1 10/2001 Kline et al.
6,318,851 B1 11/2001 Hoen et al.
6,457,821 B1 10/2002 Liu et al.
6,471,334 B2 10/2002 Kline et al.
6,481,837 B1 11/2002 Askren et al.
6,499,826 B1 12/2002 Kline et al.
6,652,080 B2 11/2003 Childs et al.
6,698,870 B2 3/2004 Gunther
6,739,706 B2 5/2004 Barinaga et al.

(Continued)

*Primary Examiner*—An H. Do
*Assistant Examiner*—Sarah Al Hashimi
(74) *Attorney, Agent, or Firm*—Taft, Stettinuis & Hollister LLP

(57) ABSTRACT

A printhead comprising a first ink reservoir in fluid communication with an outlet nozzle and downstream from a first ink filter, and a pump assembly in fluid communication with the first ink reservoir and operative to withdraw gas from the first ink reservoir and subsequently inhibit fluid communication between the withdrawn gas and the first ink reservoir. The present invention also includes method of removing gas in fluid communication with an ink reservoir, the method comprising purging gas from a gas accumulation area of an ink reservoir, where purging act includes manipulating a valve assembly downstream from an ink filter, the valve assembly operative to separate the gas accumulation area of the ink reservoir from an external environment, the valve assembly operative to facilitate unidirectional volumetric flow of the gas between the gas accumulation area and the external environment.

24 Claims, 6 Drawing Sheets

U.S. PATENT DOCUMENTS 6,752,493 B2 6/2004 Dowell et al.
6,761,445 B2 7/2004 Hoen et al.
6,773,097 B2 8/2004 Dowell
6,874,872 B2 * 4/2005 Lewis et al. ..... 347/85
7,118,206 B1 * 10/2006 Stockwell et al. ..... 347/92
2002/0057972 A1 * 5/2002 Barinaga et al. ..... 417/413.3
2004/0020552 A1 * 2/2004 Ruffer et al. ..... 141/7
2005/0084952 A1 * 4/2005 Bass et al. ..... 435/287.2
2005/0168520 A1 * 8/2005 Mantooth et al. ..... 347/30
2006/0114298 A1 * 6/2006 Anderson et al. ..... 347/85

* cited by examiner

METHODS AND DEVICES FOR PURGING GASES FROM AN INK RESERVOIR

BACKGROUND

1. Field of the Invention

The present invention is directed to drop-on-demand printing, and more specifically to inkjet printing. The invention includes devices and methods for purging gases becoming entrapped within an ink concourse between an ink supply source and an ejection point at the nozzle tip.

2. Background of the Invention

One of the major problems with on-carrier tank systems ("chiclet systems") concerns the accumulation of air within the ink filter tower. If an ink reservoir is run too low, or left out of the printer for an extended period of time, air may accumulate within the filter tower and block ink from reaching the nozzles; i.e., starving the chip. These conditions will result in premature printhead failure. Several causes are known for the accumulation of air within the ink concourse and include, without limitation, air permeation through the ink supply conduits, air forced into the ink supply conduits resulting from the exchange of ink tanks, as well as dissolved air within the ink that comes out of solution. Therefore, there is a need in the art to develop devices and techniques for obviating air accumulation downstream from an ink filter.

SUMMARY OF THE INVENTION

The present invention is directed to devices and methods that reduce the likelihood of premature printhead failure caused by starvation of the printhead attributable to gaseous blockages. An exemplary embodiment of the present invention may include an ink reservoir fabricated with special geometric features that provide for gaseous accumulation and separation of the accumulated gases from the liquid ink. Another exemplary embodiment of the present invention may also make use of pumps and valve assemblies that withdraw gases from within one or more ink reservoirs and expel the withdrawn gas to an environment external to the ink reservoirs. A further detailed exemplary embodiment may include refillable ink reservoirs having one or more couplings adapted to interface with removable ink tanks, where the direction of insertion is at least partially horizontal.

In accordance with an embodiment of the present invention a printhead is provided that includes: (a) a first ink reservoir in fluid communication with an outlet nozzle and downstream from a first ink filter; and (b) a pump assembly in fluid communication with the first ink reservoir and operative to withdraw gas from the first ink reservoir and subsequently inhibit fluid communication between the withdrawn gas and the first ink reservoir.

In an embodiment, the pump assembly includes a one-way valve assembly in concurrent fluid communication with an interior of the first ink reservoir and an external environment, and the one-way valve assembly includes a first valve and a second valve. In yet another more detailed embodiment, a pump of the pump assembly fluidicly interposes the first valve and the second valve. In a further detailed embodiment, the first valve is operative to isolate the second valve from the interior of the first ink reservoir. In still a further detailed embodiment, the one-way valve assembly includes a first valve that includes a first valve seat adapted to receive a first valve body, where the first valve body is biased against the first valve seat, and a second valve that includes a second valve seat adapted to receive a second valve body, where the second valve body is biased against the second valve seat. In a more detailed embodiment, the first valve seat includes a first circular opening, the first valve body includes a first spherical body adapted to be received within the first circular opening, the second valve seat includes a second circular opening, and the second valve body includes a second spherical body adapted to be received within the second circular opening.

In another embodiment, the pump assembly includes a pump operative to overcome the bias of the first valve body by generating a first pressure differential between an upstream side and a downstream side of the first valve, thereby providing fluid communication between the upstream side and the downstream side of the first valve, the pump is operative to overcome the bias of the second valve body by generating a second pressure differential between an upstream side and a downstream side of the second valve, thereby providing fluid communication between the upstream side and the downstream side of the second valve, and the downstream side of the first valve is in fluid communication with the upstream side of the second valve. In still another more detailed embodiment, the pump includes a diaphragm deformable to generate the first pressure differential and the second pressure differential, and the diaphragm is manually deformable. In a further detailed embodiment, the printhead further comprises a second ink reservoir in fluid communication with a second outlet nozzle and downstream from a second ink filter and a third ink reservoir in fluid communication with a third outlet nozzle and downstream from a third ink filter, where the second ink reservoir and the third ink reservoir are in fluid communication with the pump assembly operative to withdraw gas from the second ink reservoir and the third ink reservoir and subsequently inhibit fluid communication between the withdrawn gas and the second ink reservoir and the third ink reservoir.

In another embodiment, the pump assembly includes a one-way valve assembly in concurrent fluid communication with an interior of the first ink reservoir, an interior of the second ink reservoir, an interior of the third ink reservoir, and an external environment, and the one-way valve assembly includes a first valve, a second valve, a third valve, and a fourth valve. In still another more detailed embodiment, the pump assembly includes a pump that fluidicly interposes the first valve and the fourth valve, fluidicly interposes the second valve and the fourth valve, and fluidicly interposes the third valve and the fourth valve. In a further detailed embodiment, the first valve is operative to isolate the fourth valve from the interior of the first ink reservoir, the second valve is operative to isolate the fourth valve from the interior of the second ink reservoir, and the third valve is operative to isolate the fourth valve from the interior of the third ink reservoir. In a more detailed embodiment, the first valve includes a first valve seat adapted to receive a first valve body, where the first valve body is biased against the first valve seat, the second valve includes a second valve seat adapted to receive a second valve body, where the second valve body is biased against the second valve seat, the third valve includes a third valve seat adapted to receive a third valve body, where the third valve body is biased against the third valve seat, and the fourth valve includes a fourth valve seat adapted to receive a fourth valve body, where the fourth valve body is biased against the fourth valve seat.

In accordance with another embodiment of the present invention, an inkjet printing component is described that includes: (a) an ink reservoir including: (i) an ink exit orifice at a first elevation, (ii) a gaseous exit orifice at a second elevation, where the second elevation is higher than the first elevation, (iii) a gas accumulation area in fluid communication with the gaseous exit orifice; (b) an ink filter in fluid communication with an interior of the ink reservoir; and (c) a pump assembly operative to withdraw gas through the gaseous exit orifice and from the gas accumulation area and subsequently inhibit fluid communication between the withdrawn gas and the interior of the ink reservoir.

In another embodiment, the ink reservoir includes an ink entrance orifice at a third elevation, the ink filter is in series with the ink entrance orifice, and the second elevation is higher than the third elevation. In still another more detailed embodiment, the ink reservoir includes a first inlet coupling adapted to interface with a first outlet coupling of a replacement ink tank, where the replacement ink tank is laterally coupled to the ink reservoir.

Another embodiment of the invention describes a method of increasing the longevity of a printhead, the method comprising displacing gas within an ink reservoir, where the gas displaced was located downstream from an ink filter, where the act of displacing the gas includes implementing a gas accumulation area within the ink reservoir.

In yet another embodiment, the act of displacing the gas includes withdrawing the gas from within the ink reservoir and inhibiting fluid communication between the gas withdrawn and liquid ink within the ink reservoir, and the act of withdrawing the gas from within the ink reservoir includes opening a check valve to provide fluid communication between the gas accumulation area and a gas containment area. In still another more detailed embodiment, the method further comprises pumping the withdrawn gas into an area not in fluid communication with the ink reservoir.

Another embodiment pertains to a method of removing gas in fluid communication with an ink reservoir, the method comprising purging gas from a gas accumulation area of an ink reservoir, where purging act includes manipulating a valve assembly downstream from an ink filter, the valve assembly operative to separate the gas accumulation area of the ink reservoir from an external environment, the valve assembly operative to facilitate unidirectional volumetric flow of the gas between the gas accumulation area and the external environment.

DETAILED DESCRIPTION

The exemplary embodiments of the present invention are described and illustrated below to encompass devices and methods to reduce the likelihood of gaseous blockages within the concourse of a printhead. Of course, it will be apparent to those of ordinary skill in the art that the preferred embodiments discussed below are exemplary in nature and may be reconfigured without departing from the scope and spirit of the present invention. However, for clarity and precision, the exemplary embodiments as discussed below may include optional features and steps that one of ordinary skill will recognize as not being a requisite to fall within the scope of the present invention.

Figure 1:
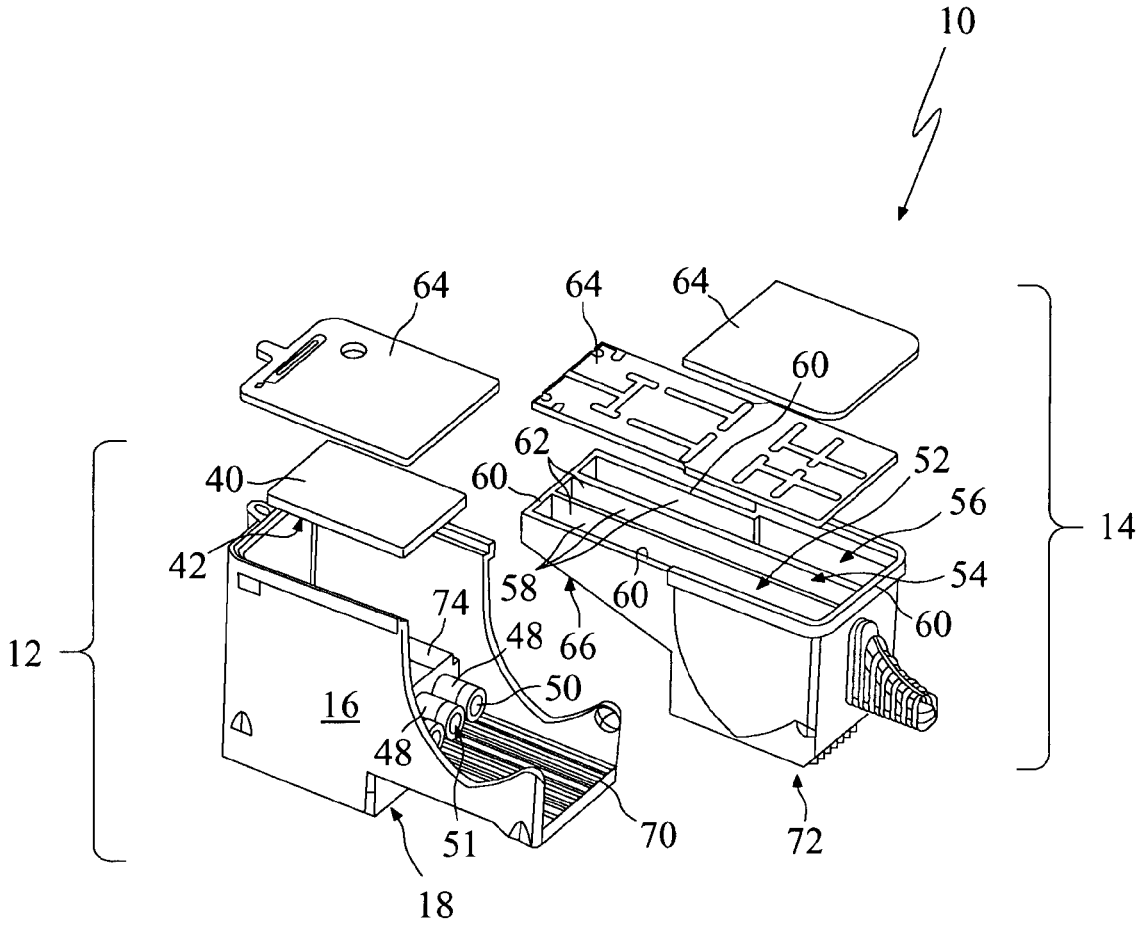
FIG. 1 is an exploded view of a first exemplary printhead in accordance with the present invention.
Figure 2:
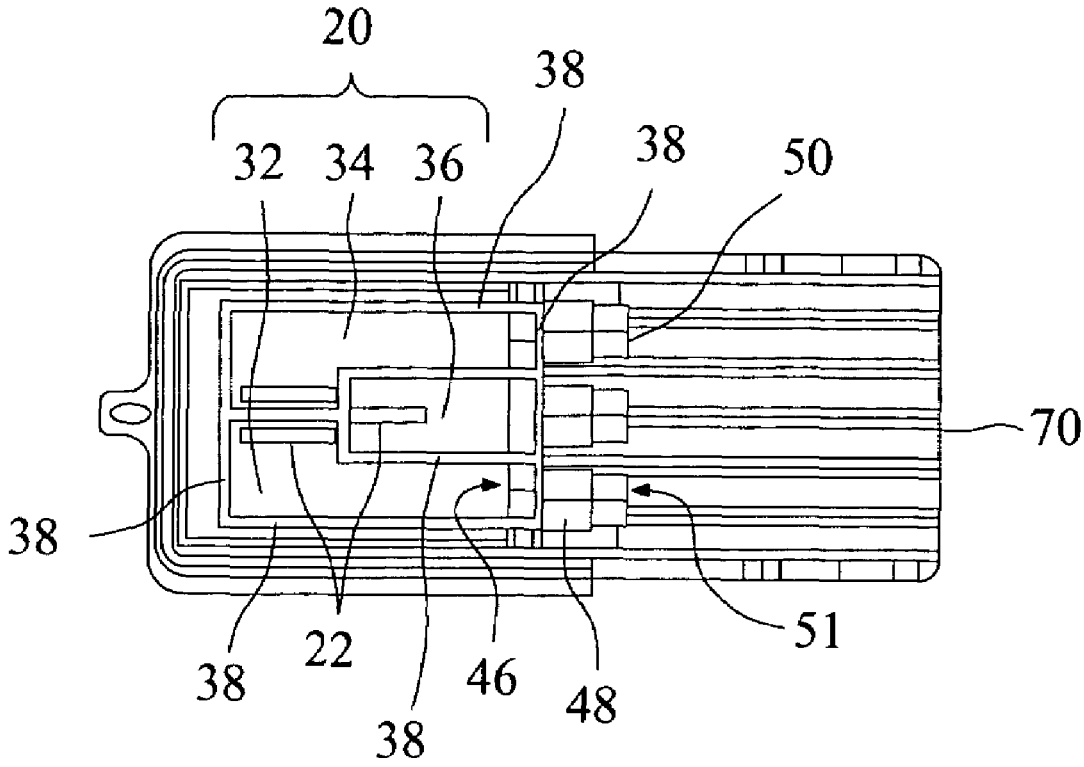
FIG. 2 is an overhead view of a first exemplary printhead body in accordance with the present invention.
Figure 3:
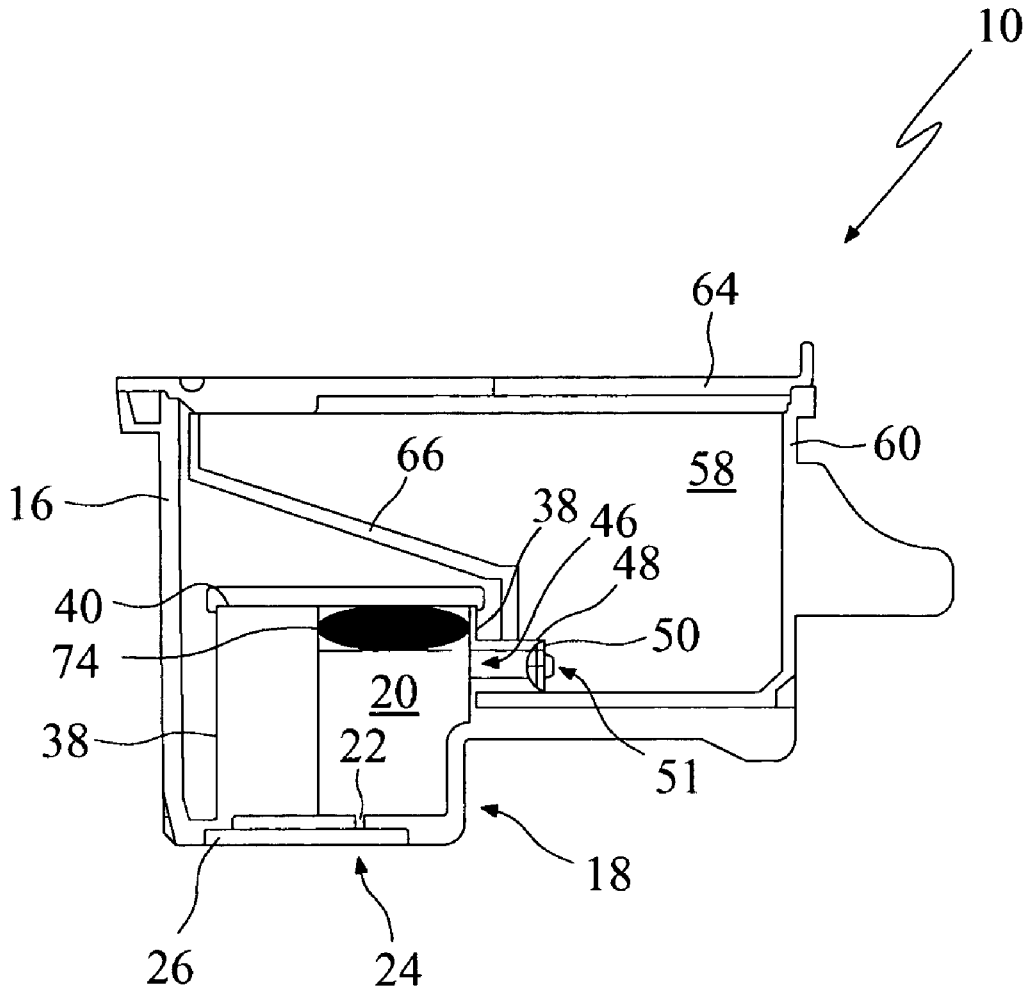
FIG. 3 is a cross-sectional view from the side of the first exemplary printhead of FIG. 1.

Referencing FIGS. 1-3, a first exemplary printhead 10 includes a printhead body 12 adapted to have a removable ink tank cartridge 14 mounted thereto. The printhead body 12 includes an outer housing 16 that includes a recessed area 18 partially occupied by a plurality of local ink reservoirs 20. A via 22 at the bottom of each reservoir provides fluid communication between the interior of each reservoir and one or more nozzles 24 associated with a nozzle plate 26 mounted to the underside of the printhead body 12 partially defining the recessed area 18 (floor).

In this exemplary embodiment, the ink reservoirs 20 occupy a rectangular area that is subdivided to provide two L-shaped (in horizontal cross-section) towers 32, 34 and a smaller rectangular tower 36 therebetween. The interior volume of each tower 32, 34, 36 is defined by the floor of the recessed area 18, a set of vertical walls 38, and a tower cap 40. The underside 42 of the tower cap 40 receives the top portion of the vertical walls of the towers 32, 34, 36 and provides a fluidic seal separating the interior regions of one tower from another. One vertical wall 38 of each tower 32, 34, 36 includes an opening 46 adapted to provide ink to the interior of each tower. The opening 46 is bounded by a conduit 48 extending radially outward from each tower and includes an ink filter 50 in series therewith. In this exemplary embodiment, the ink filter 50 is mounted to the mouth 51 of the conduit 48. However, those of ordinary skill will understand that the filter 50 may be mounted in other locations, so long as the functionality of filtering the ink is preserved.

The mouth 51 of each conduit 48 is adapted to interface the removable ink tank cartridge 14. In this exemplary embodiment, the removable ink tank cartridge 14 comprises three fluidicly separate ink tanks 52, 54, 56 that may, for example, respectively house yellow, magenta, and cyan colored inks. Each ink tank 52, 54, 56 includes an interior region 58 adapted to be occupied by felt or foam (not shown) loaded with ink that is generally bounded by the exterior walls 60 of the cartridge 14, an interior vertical wall 62 spanning the length of the cartridge and extending to meet the floor of the cartridge, and a tank lid 64. Each interior region 58 includes a tapered floor portion 66 that is operative to direct ink through the felt or foam and toward an exit orifice (not shown) associated with each tank 52, 54, 56 as the level of ink drops from usage. The exit orifice of each tank 52, 54, 56 is adapted to be in fluid communication with its respective conduit 48 associated with one of the towers 32, 34, 36 of the printhead 12.

An exemplary installation of the removable ink tank cartridge 14 to the printhead body 12 includes orienting and aligning the exit orifices with respect to the conduits 48. The floor of the printhead body 12 includes rails 70 adapted to be received by grooves 72 within the underside of the cartridge 14 to inhibit rotation of the cartridge 14 with respect to the printhead body 12, thereby facilitating horizontal sliding of the cartridge 14 upon the floor of the printhead body 12 until the cartridge 14 abuts the body 12 such that the conduits 48 fluidicly seal with respect to the exit orifices. The fluidic seal between the conduits 48 and exit orifices is operative to inhibit gaseous flow into the conduit by way of the interface between the conduits 48 and orifices. Those of ordinary skill are familiar with the techniques for carrying out such fluidic interfaces by providing a sealing member such as a circumferential O-ring between two adjacent surfaces that are separated by the sealing member. Those of ordinary skill are also familiar with the techniques for inhibiting ink from exiting the tanks prematurely by way of unintended capillary action that include, without limitation, positioning a removable thin film over the exit orifices.

Upon mounting the cartridge 14 to the body 12, a fluid communication system is provided enabling ink to flow from a tank 52, 54, 56 into a respective tower 32, 34, 36. Those of ordinary skill are aware that mounting a cartridge 14 to a body 12 may be operative to introduce vapor into the tower. In addition, vapor may accumulate within the tower as a result of normal printing operations and as a result of dissolved vapor coming out of solution. In each of these cases, vapor accumulation may detract from printhead longevity. The first exemplary embodiment 10 manages vapor accumulation by providing a vertically oriented filter 50 and providing a vapor accumulation area 74 within each tower 32, 34, 36.

Vapor bubbles that are small enough to pass through the filter 50 are generally drawn into the ink conduit and accumulate within one of the tower 32, 34, 36. However, some vapor bubbles may be too large to pass through the filter 50 and may become an impediment to ink flow therethrough. Prior art ink filters positioned horizontally would trap such relatively large vapor bubbles as the buoyancy of the bubble attempted to drive the bubbles upward through the ink until being stopped by the underside of the filter. A vertically oriented filter 50 (i.e., orienting the active filter surface on a plane generally parallel to a vertical plane), on the other hand, minimizes the resistance to upward flow of the vapor bubbles. In addition, by providing a vapor accumulation area 74 within each tower 32, 34, 36 that is vertically elevated with respect to the position of the ink filter 50, vapor bubbles gravitate to the highest vertical point within the tower. In this manner, vapor may accumulate above the level of ink within each tower 32, 34, 36 without substantially impairing the flow of ink through each conduit 48.

Figure 4:
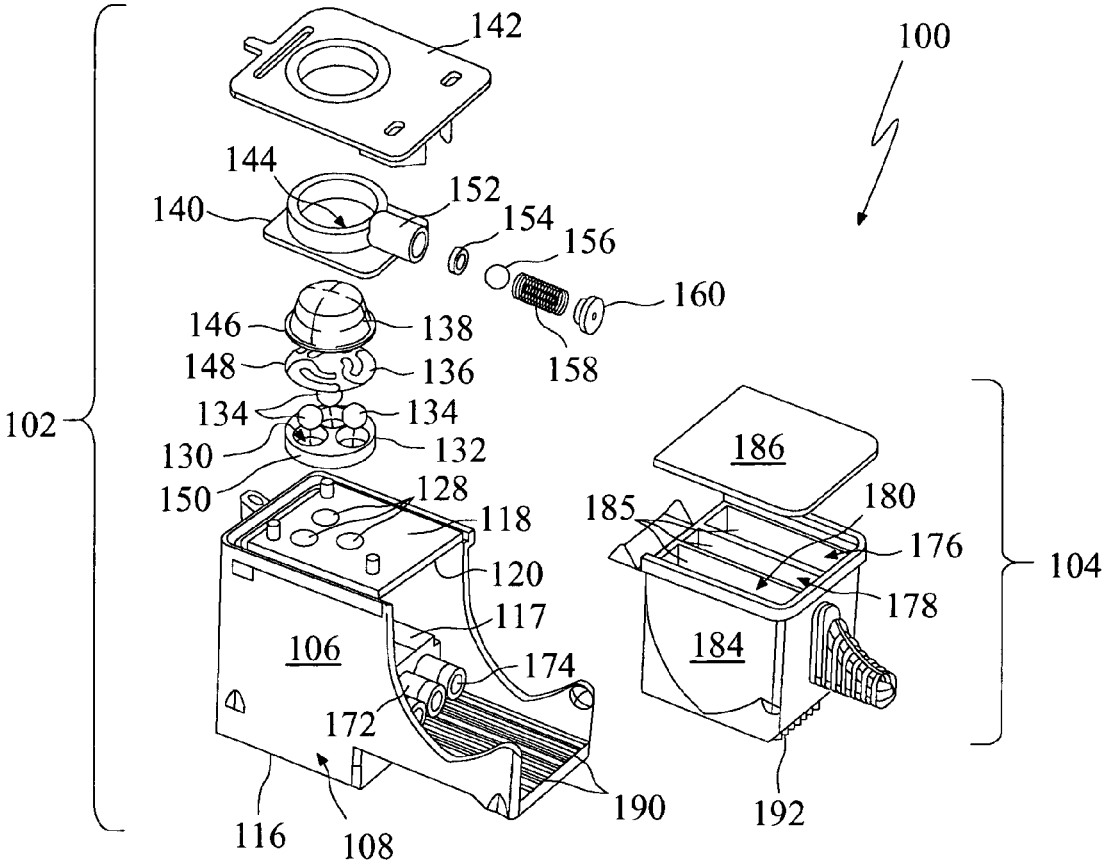
FIG. 4 is an exploded view of a second exemplary printhead in accordance with the present invention.
Figure 5:
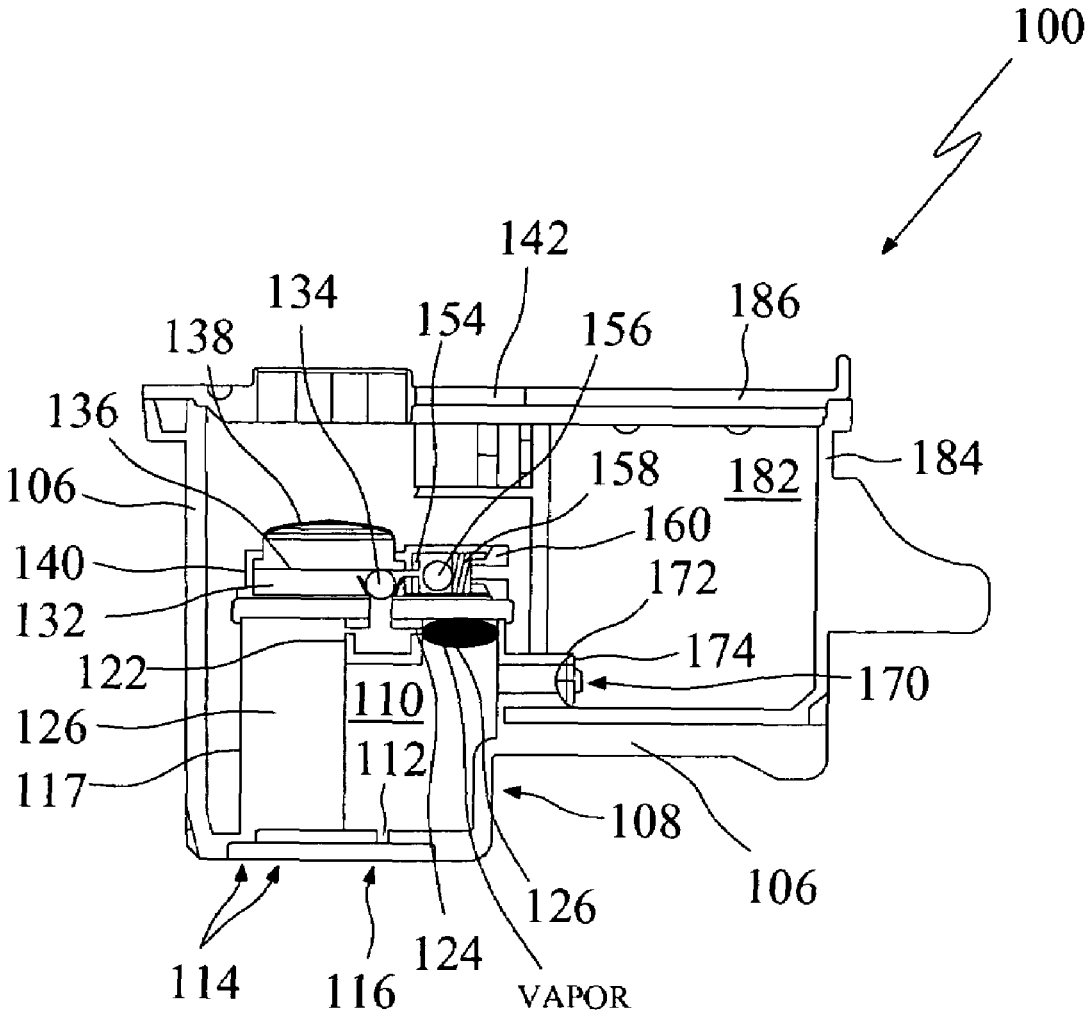
FIG. 5 is a cross-sectional view the second exemplary printhead of FIG. 4.

Referencing FIGS. 4 and 5, a second exemplary printhead 100 includes a printhead body 102 adapted to interface with a removable ink tank cartridge 104. The printhead body 102 includes an outer housing 106 that includes a recessed area 108 partially occupied by local ink reservoirs 110. A via 112 at the bottom of each reservoir provides fluid communication between the interior of each reservoir and one or more nozzles 114 associated with a nozzle plate 116 mounted to the underside of the printhead body 102 partially defining the recessed area 108 (floor).

In this second exemplary embodiment, the ink reservoirs 10 occupy a rectangular area that is subdivided to provide two L-shaped towers (not shown) and a smaller rectangular tower (not shown) therebetween. The interior volume of each tower is defined by the floor of the recessed area 108, a set of vertical walls 117, and a tower cap 118. The underside 120 of the tower cap 118 receives the top portion of the vertical walls 117 of the towers and provides a fluidic seal separating the interior region of one tower from another. The underside 120 of the tower cap 118 also includes three chambers 122, one for each tower. Each chamber 122 includes an orifice 124 in a side wall thereof in fluid communication with a vapor accumulation area 126 of each tower. The tower cap 118 also includes three orifices 128 in a triangular configuration extending into a respective vapor accumulation area 126 of each tower. The orifices 128 are aligned with three orifices 130 within a purge seal 132. The orifices 130 of the purge seal 132 are tapered inward from top to bottom and are adapted to receive check balls 134 biased against the purge seal 132 by cut-outs of a spring disc 136. A purge bulb 138 is positioned over the spring disc 136 and a purge housing 140 is positioned over the purge bulb 138. A printhead lid 142 is positioned over the housing 140 and operative to press an annular ring 144 of the housing 140 against an annular flange 146 of the bulb 138, which pushes against a circumferential portion 148 of the spring disc 136, which, in turn, pushes against a circumferential portion 150 of the purge seal 132 to compress the purge seal 132 against the tower cap 118 and provide a series of fluidic seals. In sum, the first seal is between the circumferential portion 150 of the purge seal 132 and the tower cap 118, the second seal is between the circumferential portion 150 of the purge seal 132 and the circumferential portion 148 of the spring disc 136, the third seal is between the annular flange 146 of the bulb 138 and the circumferential portion 148 of the spring disc 136, and the fourth seal is between the annular flange 146 of the bulb 138 and the annular ring 144 of the housing 140.

The purge housing 140 also includes a radially extending conduit 152 in fluid communication with the interior of the bulb 138. The conduit houses a vent seal 154 in series with a check ball 156. A conduit cap 160 is mounted to the end of the conduit 152, with a spring 158 being wedged between the conduit cap 160 and the ball 156. The conduit cap 160 provides a relatively rigid point against which the spring 158 pushes, therefore biasing the ball 156 against the seal 154 when the bulb 138 is in its inflated state (See FIG. 5).

One vertical wall 117 of each tower includes an opening 170 adapted to provide an orifice through which ink enters a conduit 172 to enter each tower. The conduit is oriented to extend away from each tower and includes an ink filter 174 in series therewith. In this exemplary embodiment, the ink filter 174 is mounted to the mouth of the conduit 172, however, it is to be understood that the precise location of the ink filter may be changed without departing from the scope and spirit of the present invention.

The mouth of each conduit 172 is adapted to interface with the removable ink tank cartridge 104. In this exemplary embodiment, the removable ink tank cartridge 104 comprises three fluidicly separate ink tanks 176, 178, 180 that may, for example, respectively house yellow, magenta, and cyan colored inks. Each ink tank 176, 178, 180 includes an interior region 182 adapted to be occupied by felt or foam (now shown) loaded with ink that is generally bounded by the exterior walls 184 of the cartridge, an interior vertical wall 185 spanning the length of the cartridge and extending to meet the floor of the cartridge, and a tank lid 186. Each interior region 182 of the tank cartridge includes an exit orifice (not shown) adapted to be in fluid communication with its corresponding conduit 172 associated with one of the towers of the printhead.

An exemplary installation of the removable ink tank cartridge 104 to the printhead body 102 includes orienting and aligning the exit orifices with respect to the conduits 172. The floor of the printhead body 102 includes rails 190 adapted to be received by grooves 192 within the underside of the cartridge 104 to inhibit rotation of the cartridge 104 with respect to the printhead body 102, thereby facilitating horizontal sliding of the cartridge 104 upon the floor of the printhead body 102 until the cartridge 104 abuts the body 102 such that the conduits 172 fluidicly seal with respect to the exit orifices. The fluidic seal between the conduits 172 and exit orifices is operative to inhibit gaseous flow into the conduit by way of the interface between the conduits 172 and orifices. Those of ordinary skill are familiar with the techniques for carrying out such fluidic interfaces such as providing a circumferential O-ring. Those of ordinary skill are also familiar with the techniques for inhibiting ink from exiting from the tanks 176, 178, 180 prematurely from unintended capillary action that include, without limitation, positioning a removable or pierceable thin film over the exit orifice.

Upon mounting the cartridge 104 to the body 102, a fluid communication system is provided enabling ink to flow from the tanks 176, 178, 180 into the towers. Those of ordinary skill are aware that mounting a cartridge 104 to a body 102 may be operative to introduce vapor into the tower. In addition, vapor may accumulate within a tower as a result of normal printing operations and as a result of dissolved vapor coming out of solution. In each of these cases, vapor accumulation may degrade the longevity of the printhead. The second exemplary embodiment 100 manages vapor accumulation by providing vertically oriented filters 174 within conduits 172; providing a vapor accumulation area 126 within each tank 176, 178, 180 positioned above and in fluid communication with the filter 174; and providing a purge system to remove vapor present within the vapor accumulation area 126.

Referencing FIGS. 4 and 5, an exemplary operation of the purge system of the printhead 100 will be discussed below. For purposes of illustration, it is presumed that the ink tank cartridge 104 has been mounted to the printhead body 102 to provide a fluidic interface between the towers of the printhead and the tanks 176, 178, 180 of the cartridge 104.

Vapor present within any of the towers will be directed upward to the vapor accumulation area 126. For purposes of illustration, accumulated vapor within a tower is shown as a black oval labeled "VAPOR". The amount of vapor within the accumulation area 126, in this exemplary illustration, pushes the level of ink within the tower below the height of the orifice 124 within the chamber 122. To reduce the vapor within the towers, the bulb 138 is actuated from an inflated state to a deflated state. Actuation of the bulb 138 results from a downward force applied to the exterior of the bulb 138, such as, without limitation, by a user pushing his finger against the bulb 138. It is to be understood that the description of the bulb 138 in an inflated state or a deflated state is comparative in nature and refers to positions of the bulb where the interior area defined by the walls of the bulb 138 is either decreased (deflated) or increased (inflated). Thus, an inflated state only means that the interior area of the bulb 138 can be further decreased, and the deflated states only means that the interior area of the bulb 138 can be further increased, comparatively speaking. The actuation of the bulb 138 from an inflated state to a deflated state forces gas from the interior of the bulb 138 and creates a temporary region of higher pressure gas pushing against each of the check balls 134, 156. The higher pressure gas pushes the check balls 134 against the purge seal 132 and is operative to form a seal therebetween, thereby inhibiting the higher pressure gas from passing into the chambers 122. However, this higher pressure gas provides a force pushing against the ball 156 sufficient to overcome the bias of the spring 158 and dislodge the ball 156 from the vent seal 154 to enable the gas to pass through the conduit 152 and into an external environment. As gas escapes into the external environment, the pressure acting on the ball 156 decreases and at a certain point, the pressure of the gas is no longer great enough to overcome the bias of the spring 158. When this occurs, the ball 156 is forced against the vent seal 154 and seals off the external environment from the gas within the system. The bulb 138 at this point is roughly in a deflated state, and it is within the scope and spirit of the present invention that the bulb 138 be comprised of a resilient material. The resiliency of the bulb 138 results in the bulb attempting to return to its inflated state, which provides a lower pressure area approximate the check balls 134. The pressure differential across the check balls 134 is operative to displace one or more of the balls and allow higher pressure vapor/gas from the chambers 122 to flow through one or more of the orifices 128 within the tower cap 118 and through one or more orifices 130 of the purge seal 132 and into the interior inflated area of the bulb 138. The orifice 124 of each chamber 122 is adapted to be positioned adjacent to the top height of the tower so that nearly all of the vapor within the tower is extracted before ink is drawn into the chamber. As ink is drawn into the chamber 122 and elevates to reach the check ball 134, the wetting effect between the ink, ball 134, and seal 132 is operative to provide a seal such that vapor from the other towers will be extracted prior to ink passing beyond the ball 134. In this manner, vapor within each tower may be concurrently extracted by a single purging operation.

Figure 6:
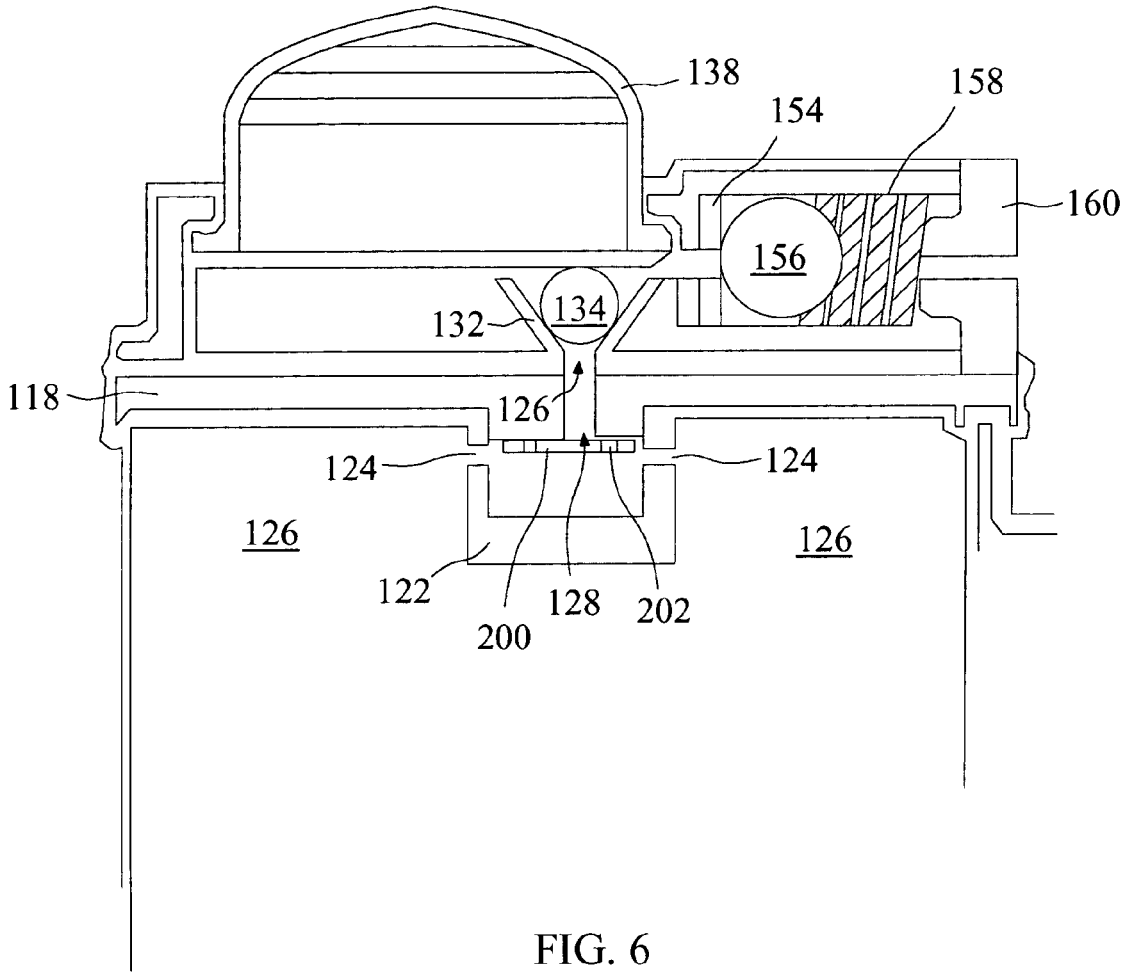
FIG. 6 is an isolated cross-sectional view of a second alternate exemplary embodiment of the present invention.

Referencing FIG. 6, it is also within the scope of the present invention to provide a float 200 within each chamber 122 that is operative to abut the orifice 128 in the tower cap 118 and seal off the opening, thereby prohibiting liquid ink from reaching the check ball 134. In this manner, as ink is drawn into the chamber 122, via the orifice 124, the float 200 would ride upon the level of ink within the chamber 122. As the level of ink rises within the chamber 122, the float 200 is operative to abut the orifice 128 and form a seal therebetween to discontinue fluid communication between the chamber 122 and the interior of the bulb 138. Those of ordinary skill will understand the numerous options for providing a float 200 within the chamber 122, such as providing holes 202 through the float 200 to allow the buoyant nature of the float 200 to rise to the top of the ink, even when ink is deposited on top of the float 200.

It is also within the scope of the present invention to automate the purging system by providing an automated mechanical ram operative to deflate the bulb 138 and purge gases from within the reservoirs. Those of ordinary skill are familiar with exemplary automated systems that could provide the necessary mechanical deflection the bulb in order to provide a purging sequence based upon the current disclosure.

Following from the above description and invention summaries, it should be apparent to those of ordinary skill in the art that, while the methods and apparatuses herein described constitute exemplary embodiments of the present invention, the invention contained herein is not limited to this precise embodiment and that changes may be made to such embodiments without departing from the scope of the invention as defined by the claims. Additionally, it is to be understood that the invention is defined by the claims and it is not intended that any limitations or elements describing the exemplary embodiments set forth herein are to be incorporated into the interpretation of any claim element unless such limitation or element is explicitly stated. Likewise, it is to be understood that it is not necessary to meet any or all of the identified advantages or objects of the invention disclosed herein in order to fall within the scope of any claims, since the invention is defined by the claims and since inherent and/or unforeseen advantages of the present invention may exist even though they may not have been explicitly discussed herein.

What is claimed is:

1. A printhead comprising:

a first ink reservoir in fluid communication with an outlet nozzle and downstream from a first ink filter; and a pump assembly in fluid communication with the first ink reservoir and operative to withdraw gas from the first ink reservoir and subsequently inhibit fluid communication between the withdrawn gas and the first ink reservoir, wherein:

the pump assembly includes a pump and a one-way valve assembly in concurrent fluid communication with an interior of the first ink reservoir and an external environment;

the one-way valve assembly includes a first one-way valve and a second one-way valve; and the first one-way valve is operative to isolate the second one-way valve from the interior of the first ink reservoir and the second one-way valve is operative to isolate the first one-way valve from the external environment.

2. The printhead of claim 1, wherein the pump fluidicly interposes the first one-way valve and the second one-way valve.

3. The printhead of claim 1, wherein:

the first one-way valve includes a first valve seat adapted to receive a first valve body, where the first valve body is biased against the first valve seat; and the second one-way valve includes a second valve seat adapted to receive a second valve body, where the second valve body is biased against the second valve seat.

4. The printhead of claim 3, wherein:

the first valve seat includes a first circular opening;

the first valve body includes a first spherical body adapted to be received within the first circular opening;

the second valve seat includes a second circular opening; and the second valve body includes a second spherical body adapted to be received within the second circular opening.

5. The printhead of claim 3, wherein;

the pump is operative to overcome the bias of the first valve body by generating a first pressure differential between an upstream side and a downstream side of the first one-way valve, thereby providing fluid communication between the upstream side and the downstream side of the first one-way valve;

the pump is operative to overcome the bias of the second valve body by generating a second pressure differential between an upstream side and a downstream side of the second one-way valve, thereby providing fluid communication between the upstream side and the downstream side of the second one-way valve; and the downstream side of the first one-way valve is in fluid communication with the upstream side of the second one-way valve.

6. The printhead of claim 5, wherein:

the pump includes a diaphragm deformable to generate the first pressure differential and the second pressure differential; and the diaphragm is manually deformable.

7. The printhead of claim 1, further comprising:

a second ink reservoir in fluid communication with a second outlet nozzle and downstream from a second ink filler;

a third ink reservoir in fluid communication with a third outlet nozzle and downstream from a third ink filter; and where the second ink reservoir and the third ink reservoir are in fluid communication with the pump assembly operative to withdraw gas from the second ink reservoir and the third ink reservoir and subsequently inhibit fluid communication between the withdrawn gas and the second ink reservoir and the third ink reservoir.

8. The printhead of claim 7, wherein:

the one-way valve assembly is in concurrent fluid communication with the interior of the first ink reservoir, an interior of the second ink reservoir, an interior of the third ink reservoir, and an external environment; and the one-way valve assembly further includes a third valve, and a fourth valve.

9. The printhead of claim 8, wherein:

the pump fluidicly interposes the first one-way valve and the fourth valve, fluidicly interposes the second one-way valve and the fourth valve, and fluidicly interposes the third valve and the fourth valve.

10. The printhead of claim 8, wherein:

the first one-way valve is operative to isolate the fourth valve from the interior of the first ink reservoir;

the second one-way valve is operative to isolate the fourth valve from the interior of the second ink reservoir; and the third valve is operative to isolate the fourth valve from the interior of the third ink reservoir.

11. The printhead of claim 8, wherein:

the first one-way valve includes a first valve seat adapted to receive a first valve body, where the first valve body is biased against the first valve seat;

the second one-way valve includes a second valve seat adapted to receive a second valve body, where the second valve body is biased against the second valve seat;

the third valve includes a third valve seat adapted to receive a third valve body, where the third valve body is biased against the third valve seat; and the fourth valve includes a fourth valve seat adapted to receive a fourth valve body, where the fourth valve body is biased against the fourth valve seat.

12. The printhead of claim 11, wherein:

the pump is operative to overcome the bias of the first valve body by generating a first pressure differential between an upstream side and a downstream side of the first one-way valve, thereby providing fluid communication between the upstream side and the downstream side of the first one-way valve;

the pump is operative to overcome the bias of the second valve body by generating a second pressure differential between an upstream side and a downstream side of the second one-way valve, thereby providing fluid communication between the upstream side and the downstream side of the second one-way valve;

the pump is operative to overcome the bias of the third valve body by generating a third pressure differential between an upstream side and a downstream side of the third valve, thereby providing fluid communication between the upstream side and the downstream side of the third valve;

the pump is operative to overcome the bias of the fourth valve body by generating a fourth pressure differential between an upstream side and a downstream side of the fourth valve, thereby providing fluid communication between the upstream side and the downstream side of the fourth valve; and the downstream side of the first one-way valve, the second one-way valve, and the third valve are in fluid communication with the upstream side of the fourth valve.

13. The printhead of claim 12, wherein:

the pump includes a diaphragm deformable to generate the first pressure differential, the second pressure differential, and the third pressure differential; and the diaphragm is manually deformable.

14. The printhead of claim 7, wherein:

the first ink reservoir includes a first inlet coupling adapted to interface with a first outlet coupling of a first ink supply source to provide a fluidic seal between the first ink supply source and the first ink reservoir;

the second ink reservoir includes a second inlet coupling adapted to interface with a second outlet coupling of a second ink supply source to provide a fluidic seal between the second ink supply source and the second ink reservoir;

the third ink reservoir includes a third inlet coupling adapted to interface with a third outlet coupling of a third ink supply source to provide a fluidic seal between the third ink supply source and the third ink reservoir;

the first inlet coupling is adapted to be interfaced horizontally by the first outlet coupling;

the second inlet coupling is adapted to be interfaced horizontally by the second outlet coupling; and the third inlet coupling is adapted to be interfaced horizontally by the third outlet coupling.

15. The printhead of claim 1, wherein:

the first ink reservoir includes a first inlet coupling adapted to interface with a first outlet coupling of a first ink supply source to provide a fluidic seal between the first ink supply source and the first ink reservoir; and the first inlet coupling is adapted to be interfaced horizontally by the first outlet coupling.

16. The printhead of claim 1, wherein:

the pump assembly includes a repositionable diaphragm; and the diaphragm is manually deformable.

17. The printhead of claim 1, wherein the pump assembly is mounted to the first ink reservoir.

18. An inkjet printing component comprising:

an ink reservoir including:

an ink exit orifice at a first elevation, a gaseous exit orifice at a second elevation, where the second elevation is higher than the first elevation, an ink entrance orifice, and a gas accumulation area in fluid communication with the gaseous exit orifice;

an ink filter in fluid communication with an interior of the ink reservoir; and a pump assembly including a pump fluidicly interposed between at least two one-way valves, the pump assembly operative to withdraw gas through the gaseous exit orifice end from the gas accumulation area and subsequently inhibit fluid communication between the withdrawn gas and the interior of the ink reservoir, wherein at least part of the ink entrance orifice is at a lower elevation than that of the gaseous exit orifice and lower than the gas accumulation area.

19. The inkjet printing component of claim 18, wherein the ink reservoir includes a first inlet coupling adapted to interface with a first outlet coupling of a replacement ink tank, where the replacement ink tank is laterally coupled to the ink reservoir.

20. A method of increasing the longevity of a printhead, the method comprising:

displacing gas within an ink reservoir, where the gas displaced was located downstream from an ink filter; and wherein the act of displacing the gas includes implementing a gas accumulation area within the ink reservoir;

wherein the act of displacing the gas includes withdrawing the gas from within the ink reservoir and inhibiting fluid communication between the gas withdrawn and liquid ink within the ink reservoir; and wherein the act of withdrawing the gas from within the ink reservoir includes opening a check valve to provide fluid communication between the gas accumulation area and a gas containment area.

21. The method of claim 20, further comprising pumping the withdrawn gas into an area not in fluid communication with the ink reservoir.

22. A method of removing gas in fluid communication with an ink reservoir, the method comprising:

purging gas from a gas accumulation area of an ink reservoir using a one-way valve assembly, where the purging act includes manipulating a first and a second valves of the one-way valve assembly downstream from an ink filter, the valve assembly operative to separate the gas accumulation area of the ink reservoir from an external environment, the valve assembly operative to facilitate unidirectional volumetric flow of the gas between the gas accumulation area end the external environment, where the first valve is operative to isolate the second valve from the gas accumulation area of the ink reservoir.

23. A printhead comprising:

a first ink reservoir in fluid communication with a nozzle outlet and downstream from a vertically oriented ink filter, the first ink reservoir including an air accumulation region elevated with respect to the vertical filter, wherein vapor bubbles downstream from the ink filter are directed to the vapor accumulation area.

24. An inkjet printing component comprising:

an ink reservoir including:

an ink exit orifice at a first elevation, a gaseous exit orifice at a second elevation, where the second elevation is higher than the first elevation, a gas accumulation area in fluid communication with the gaseous exit orifice;

an ink filter in fluid communication with an interior of the ink reservoir; and a pump assembly operative to withdraw gas through the gaseous exit orifice and from the gas accumulation area and subsequently inhibit fluid communication between the withdrawn gas and the interior of the ink reservoir, wherein the ink reservoir includes a first inlet coupling adapted to interface with a first outlet coupling of a replacement ink tank, where the replacement ink tank is laterally coupled to the ink reservoir.

* * * * *